United States Patent [19]

Ulrich, II et al.

[11] 4,121,687

[45] Oct. 24, 1978

[54] CONTROL SYSTEM FOR HYDRAULIC LIFTS

[75] Inventors: Roy E. Ulrich, II, Lancaster; Gerard Engel, Parksburg, both of Pa.

[73] Assignee: Ulrich Supply Company, Inc., . Lancaster, Pa.

[21] Appl. No.: 740,122

[22] Filed: Nov. 8, 1976

[51] Int. Cl.[2] ..... B66F 11/04

[52] U.S. Cl. ..... 182/2; 60/433

[58] Field of Search ..... 182/2; 60/433; 91/442

[56] References Cited

U.S. PATENT DOCUMENTS

| | | | |
|---|---|---|---|
| 3,132,718 | 5/1964 | Pierce | 182/2 |
| 3,566,903 | 3/1971 | Honeycutt | 91/442 |
| 3,616,940 | 11/1971 | Milner | 182/2 |
| 3,860,088 | 1/1975 | Gellatly | 182/2 |
| 3,962,871 | 6/1976 | Blaha | 60/433 |
| 3,991,846 | 11/1976 | Chichester | 60/433 |

OTHER PUBLICATIONS

Society of Automotive Eng. Inc., Dale A. Knutson, pamphlet 730070.

*Primary Examiner*—Reinaldo P. Machado
*Attorney, Agent, or Firm*—Gary, Juettner & Pyle

[57] ABSTRACT

A control system for hydraulic lifts is characterized by a low pressure air circuit for controlling a high pressure closed center hydraulic circuit for operating hydraulic cylinders of the lift.

In the disclosed embodiment the control system is for operating a hydraulic bucket lift, and the air circuit has a plurality of air switches which are actuable to provide compressed air at outlets from the circuit. The hydraulic circuit includes fluid valves operated by the compressed air at the outlets from the air circuit, and a fluid pump which operates only upon actuation of the circuit to move the cylinder, yet which maintains full hydraulic pressure at all other times for rapid system response. Adjustable metering valves control the volume flow of fluid to the cylinders to smooth and control the speed of operation thereof, and therefore of the lift.

As a consequence of the hydraulic circuit being of the closed center type, a plurality of lift functions may be simultaneously performed without a loss of operating speed, and since the pump operates only upon system actuation, it is efficient to run and system wear is minimized. Further, as the switches for controlling operation of the lift are low pressure air switches, rupture of a switch or an air supply line does not present a hazard to an operator of the lift.

14 Claims, 2 Drawing Figures

CONTROL SYSTEM FOR HYDRAULIC LIFTS

BACKGROUND OF THE INVENTION

The present invention relates to an improved control system for hydraulic lifts.

Hydraulic bucket lifts are generally comprised of a ground station or base, which may be mounted on a bed of a truck where the lift is to be transportable, and a bucket for holding one of more persons. Two or more pivotally interconnected mechanical arms extend between the base and the bucket, and are movable by hydraulic cylinders to raise and to lower the bucket, and the base is rotatable by one or more hydraulic cylinders. Controls, which are normally located both at the ground station and in the bucket, operate fluid flow valves connected with the hydraulic cylinders, whereby the cylinders may be selectively operated to move the bucket to desired positions.

Conventionally, hydraulic control systems for the cylinders are of the open center type. With such systems, the fluid constantly flows in a series path through the valves, and to operate a cylinder the fluid flow at the valve therefor is blocked. This is accomplished by directing the fluid flow at each valve through associated controls at the ground station and in the bucket, with actuation at one of the controls blocking the fluid flow at the valve. As a consequence of the hydraulic fluid constantly flowing through the system at relatively high back pressure on the order of 600 psi, heat is generated within the system and shortens the life the components thereof, and a pump for the fluid is expensive to operate and wears out rapidly. Also, only one hydraulic cylinder at a time may ordinarily be operated, since during its operation fluid flow to the remaining "downstream" portion of the system is blocked. Alternatively, a second cylinder may be simultaneously operated with the fluid exhausted from the first, but then both cylinders operate at a greatly reduced speed.

As fluid lines to the controls carry the full fluid flow and pressures of the system, they are of relatively large diameter and expensive. The lines to controls in the bucket extend in a tight bundle along the mechanical arms, and are particularly subject to flexing and wear at the pivot points of the arms. Replacement of these lines is time consuming and difficult. More importantly, because the lines carry full system fluid pressures, bursting of a line in proximity with a control could cause injury to a nearby operator.

OBJECTS OF THE INVENTION

Accordingly, an object of the present invention is to provide a control system for hydraulic lifts wherein a plurality of lift functions may be simultaneously performed without a loss in operating speed.

Another object of the present invention is to provide such a control system, wherein hydraulic fluid flows through the system only during operation thereof to maximize system operating efficiency and to minimize wear thereto.

A further object of the present invention is to provide such a control system for hydraulic lifts, wherein operator actuable control switches are in a low pressure air system separate from a high pressure hydraulic system controlled thereby.

SUMMARY OF THE INVENTION

In accordance with the present invention, a control system for a hydraulic lift having a hydraulic cylinder with first and second fluid inlets thereto includes a closed center hydraulic circuit having a valve for receiving hydraulic fluid under pressure, the valve being connected with the inlets to the cylinder, and a circuit for controlling the valve to selectively apply fluid under pressure therethrough to one or the other of the cylinder inlets to operate the cylinder.

The valve may be a pilot controlled directional valve having first and second ports connected with the first and second cylinder inlets, respectively. A pump, which operates only upon actuation of a cylinder, provides fluid under pressure to an inlet to the valve. Each valve port is connected with its associated cylinder inlet both through an associated adjustable metering valve in parallel with a check valve, and through a pilot controlled check valve. The outlets of the check valves are toward the cylinder, and the pilot of each pilot controlled check valve is connected to sense the fluid pressure at the inlet to the other pilot controlled check valve.

In the disclosed embodiment, the control system operates a bucket lift of a type having a plurality of pivotally interconnected arms extending between a base and a bucket, and a plurality of dual inlet hydraulic cylinders are connected to pivot the arms with respect to each other to raise and to lower the bucket and to rotate the base. The control system includes a plurality of individual hydraulic circuits, each connected as aforesaid to an associated one of the cylinders. The pilots of the directional valves are actuable by compressed air supplied by a low pressure air circuit which includes a first plurality of air switches in the bucket and a second plurality of air switches at the base. The switches are connected at inlet thereto with a source of compressed air, and have outlets connected with associated pilots of the directional valves. This allows operation of the lift from either the base or the bucket, with actuation of the switches controlling the valves to selectively operate the cylinders, whereby the bucket may be moved to various positions.

As a consequence of the hydraulic circuit being closed center, a plurality of lift functions may be simultaneously performed without a loss in operating speed. Since the pump operates only upon system actuation, it is efficient to run and system wear is minimized, and during operation of the lift the metering valves control the rate of the fluid flow therethrough to control the operating speed of the lift, and to ensure smooth, nonjerky operation thereof. Should system failure occur, the pilot controlled check valves prevent uncontrolled descent of the bucket.

The foregoing and other objects, advantages and features of the invention will become apparent from the following detailed description thereof, when taken in conjunction with the appended drawings.

DETAILED DESCRIPTION

Figure 1:
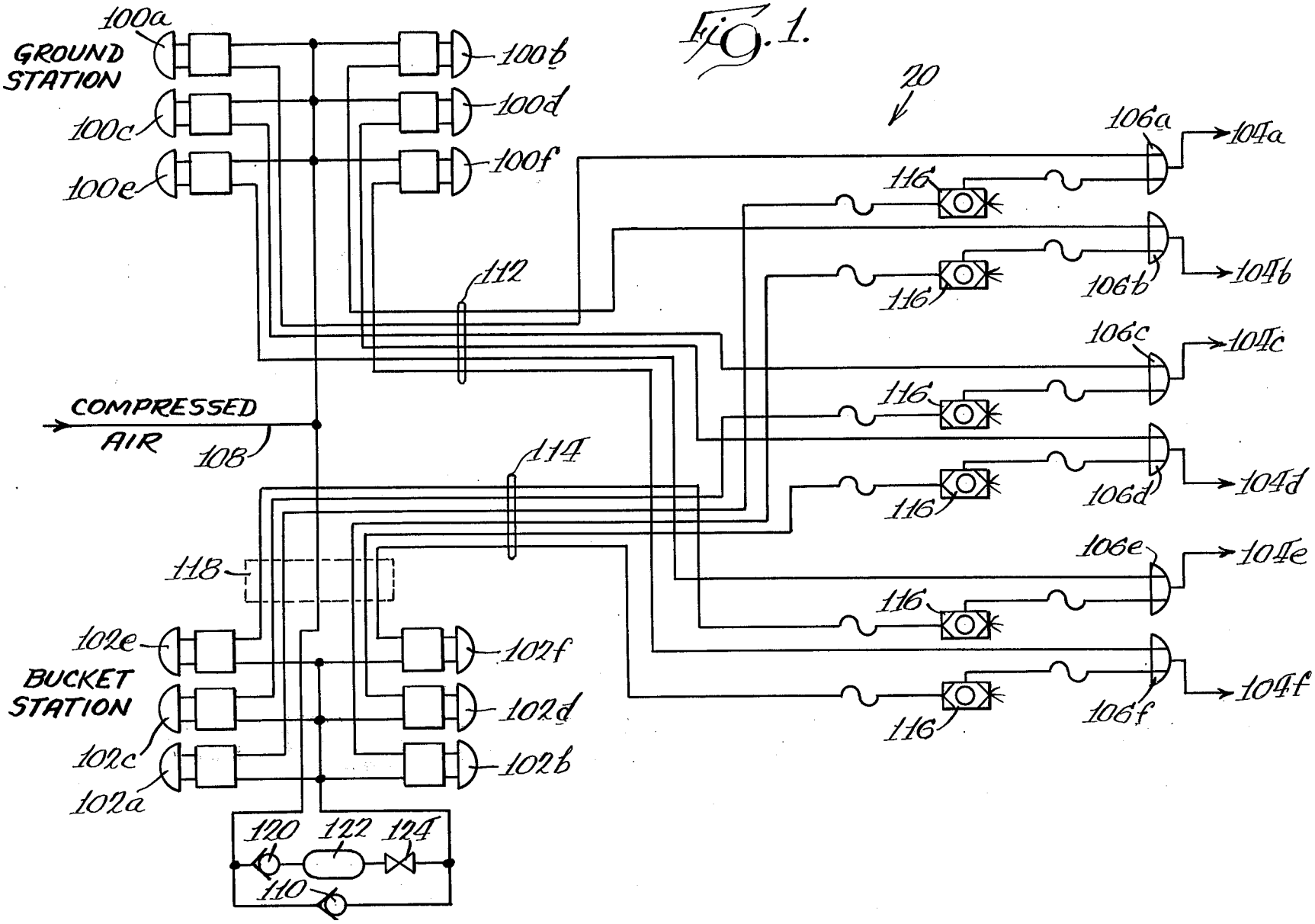
FIG. 1 illustrates a low pressure air circuit for selectively manually operating the hydraulic circuit of FIG. 2.
Figure 2:
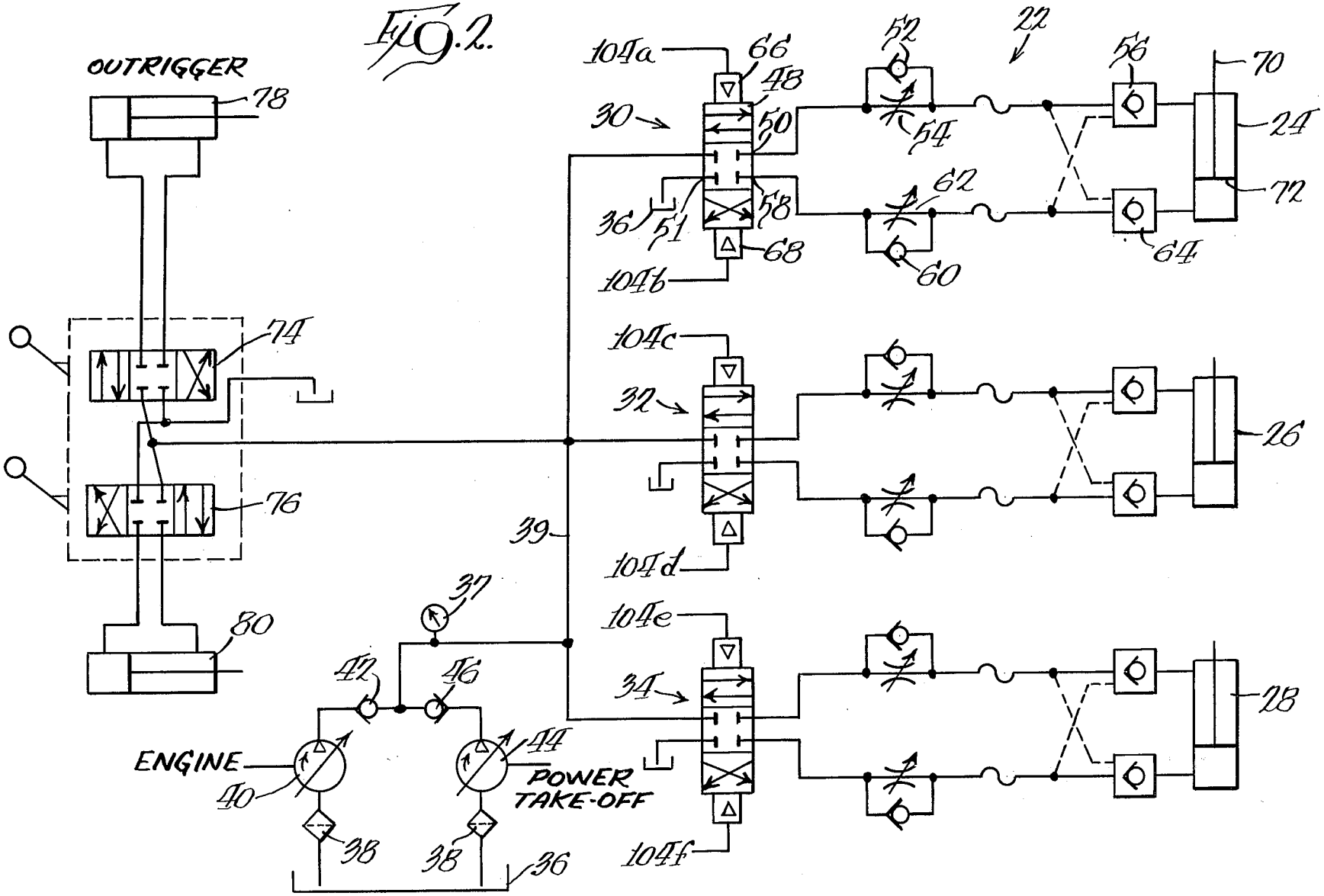
FIG. 2 illustrates a high pressure hydraulic circuit having a plurality of individual fluid circuits controllable by the air circuit of FIG. 1 to operate hydraulic lift cylinders.

The drawings illustrate in FIG. 1 a low pressure air circuit, indicated generally at 20, having a plurality of air switches which are manually actuable to provide compressed air at outlets from the circuit, and in FIG. 2 a high pressure closed center hydraulic circuit, indicated generally at 22, for operating hydraulic cylinders in response to compressed air at the outlets from the air circuit. The air circuit and the hydraulic circuit together comprise the control system of the invention for hydraulic lifts, and are particularly useful for controlling the operation of a bucket lift which is not specifically shown as comprising a part of the present invention.

A bucket lift is ordinarily comprised of a ground station or base, which may be mounted on a bed of a truck where the lift is to be transportable, and a bucket for holding and elevating one or more persons. A plurality of pivotally connected mechanical arms extend between the ground station and the bucket, and are movable by hydraulic cylinders to raise and to lower the bucket. For the three hydraulic cylinders 24, 26 and 28 shown, a bucket lift having two pivotally connected arms (not shown) may readily be operated, for example, with the cylinder 24 connected between the base of the lift and the lower arm for pivoting that arm with respect to the base, with the cylinder 26 connected between the lower arm and the upper arm for pivoting the upper arm with respect to the lower arm, and with the cylinder 28 connected to rotate the base or turret of the lift. In this manner, selective operation of the cylinders raises, lowers or rotates the bucket about the base to move the bucket to various positions.

Referring first to FIG. 2, the hydraulic circuit 22 is of the closed center type and includes three identical fluid circuits, indicated generally at 30, 32 and 34, each for operating an individual one of the hydraulic lift cylinders 24, 26 and 28. Hydraulic fluid from a reservoir or supply 36 thereof is provided to each circuit at a pressure generally on the order of 2500–3500 psi, as indicated by a pressure gauge 37, through fluid filters 38 and via a fluid line 39 either by an engine driven pump 40 operating through a check valve 42, or by a power take-off driven pump 44 operating through a check valve 46. The check valves prevent a flow of fluid through the nonoperating pump, and the use of two pumps allows selection of the power source of the hydraulic circuit, each pump also being a back-up for the other. The pumps are compensator controlled, and stop operating when system hydraulic pressure reaches a preset value, whereupon no fluid flows in the system. As a consequence, a pump operates only upon actuation of a hydraulic cylinder to move the lift, pump life is considerably extended, and the cost of operating the same is significantly reduced. Further, there is not a continuous flow of high pressure fluid through the system, as with conventional systems, which would generate considerable heat and shorten the life of system components.

With reference only to the circuit 30 for the sake of brevity, it being understood that a like description applies to identical circuits 32 and 34, the circuit includes a directional fluid valve 48 connected at an inlet 49 thereto with the high pressure fluid line 39, and connected at an outlet 51 therefrom with the fluid supply 36. A first port 50 in the valve is connected both through a check valve 52 connected in parallel with an adjustable metering valve 54, and through a pilot operated check valve 56 to a first inlet to the cylinder 24. Similarly, a second port 58 in the valve is connected both through a check valve 60 connected in parallel with an adjustable metering valve 62, and through a pilot operated check valve 64 to a second inlet to the cylinder 24. The pilot of each valve 56 and 64 is connected with the inlet to the other valve, whereby each valve may be opened for a "reverse" fluid flow therethrough upon a predetermined relationship between the fluid pressure at its check and at its pilot.

The valve 48 is controlled by a pair of air operated pilots 66 and 68 as follows: (a) without compressed air at either pilot, the valve is closed and there are no fluid passages therethrough; (b) with compressed air at the pilot 66, the high pressure fluid inlet 49 to the valve is connected with the port 50 and the outlet 51 from the valve is connected with the port 58, and (b) with compressed air at the pilot 68, the inlet to the valve is connected with the port 58 and the outlet from the valve is connected with the port 50. Thus, by selective application of compressed air to the pilots the valve may be controlled to direct high pressure hydraulic fluid to either the first or the second inlets to the cylinders 24 to move a plunger 70 thereof into or out of the cylinder, or to effectively close both inlets to the cylinder to lock the plunger in position.

For example, to move the plunger into the cylinder compressed air is applied to the pilot 66 of the valve 48 to connect the valve inlet with the port 50, and to connect the valve outlet with the port 58. This establishes a path for the high pressure fluid in the line 39 through the check valve 52 and around the metering valve 54, and through the pilot operated check valve 56 to the first inlet to the cylinder to urge a piston 72 therein in a direction to move the plunger into the cylinder. The pressure at the inlet to the valve 56 is applied at the pilot of the valve 64, and the pressure at the second inlet to the cylinder is applied against the check of the valve. When the pressure at the pilot is, say, at least 40% of the pressure against the check, the valve opens and allows fluid to escape from the cylinder through the second inlet thereto, whereby the plunger moves into the cylinder. The escaping fluid closes the check valve 60 and passes through the metering valve 62 which limits the rate of flow thereof, and then returns to the fluid supply 36 through the port 58 and the outlet 51 of the valve 48.

The metering valve 62 serves two important functions in the above described operation of the hydraulic circuit 30. First, by its adjustment it controls the rate at which fluid escapes from the cylinder 24, and therefore the operating speed of the cylinder. Second, it ensures smooth, non-jerky operation of the cylinder. With an operator in a lift bucket high above the ground, these functions take on added importance in terms of safety.

To move the plunger out of the cylinder 24, compressed air is applied to the pilot 68 of the valve. This connects the port 58 with the inlet to the valve, and the port 50 with the outlet from the valve. The circut 30 then operates generally as above, except that the direction of fluid flow therethrough is reversed. It should be noted that, for added safety, failure of the hydraulic system prior to the pilot operated check valves 56 and 64, such as a burst fluid line, removes pressure from the pilots which closes the valves and traps the fluid in the cylinder, thereby preventing rapid or uncontrolled descent of the lift.

Where the lift is carried on the bed of a truck, it is normally necessary to stabilize the truck against movement. resulting from operation of the lift. Accordingly, the hydraulic circuit 22 may also include a pair of manually actuated directional fluid valves 74 and 76 for controlling a pair of hydraulic outrigger cylinders 78 and 80. The outrigger cylinders are mounted on opposite sides of the truck, and the ends of plungers thereof are extendable against the ground to stabilize the truck against sideways rocking to prevent like rocking movement of the lift.

Referring now to FIG. 1, the air circuit 20 includes two duplicate or "sister" sets of air switches 100*a–f* and 102*a–f*, which are manually actuable to provide compressed air at associated outlets 104*a–f* from a plurality of OR elements 106*a–f*, respectively. Each OR element outlet is connected with an associated pilot of the fluid directional values of the circuits 30, 32 and 34, whereby actuation of the air switches operates the cylinders 24, 26 and 28.

The switches 100*a–f* are located at the ground station or base for being actuated by an operator thereat, and the switches 102*a–f* are located in the bucket for being actuated by an operator therein. Compressed air at a relatively low pressure on the order of 55–100 psi from a supply thereof (not shown) is connected via an air line 108 directly with inlets to the ground station switches, and through a check valve 110 with inlets to the bucket switches. The outlets from the ground station switches are connected through relatively short flexible air lines 112 with first inlets to associated ones of the OR elements, and the outlets from the bucket station switches are connected through relatively long flexible air lines 114 with second inlets to associated ones of the OR elements. Upon actuation of a ground station or a bucket switch, the OR element associated therewith provides compressed air at its outlet, and prevents a back flow of air to its "sister" switch of the duplicate set. Each air line 114 has a quick exhaust valve 116 in series therewith and approximately halfway therealong, and as the lines normally extend along the mechanical arms to the bucket a flexible protective sheath 118 is provided therearound to protect the lines against wear upon movement of the arms.

Actuation of a ground switch applies compressed air through an OR element to a pilot of a directional valve to operate a cylinder and move the lift. Upon deactuation of the switch air in the line and in the pilot is exhausted to atmosphere through the switch to close the valve and stop movement of the lift. Actuation of a bucket switch similary results in operation of a cylinder to move the lift, except that the air in a line 114 also passes through a quick exhaust valve 116. During actuation of the switch the pressure of the air closes the valve to atmosphere and the valve couples the air through the line. Upon deactuation the switch opens to atmosphere, whereupon the valve opens to atmosphere to exhaust the air in the pilot and in the line between the valve and the pilot, while the switch exhausts the air in the line to the valve. The quick exhaust valves thus rapidly vent to atmosphere compressed air in the relatively long lines 114 to rapidly stop operation of the lift upon deactuation of a bucket switch.

For convenience and safety in the event of a loss of compressed air, a check valve 120, an air accumulator tank 122 and manual shut off valve 124 are located in the bucket and connected in series with each other in parallel with the check valve 110. The valve 124 is normally closed and the tank 122 stores therein an emergency supply of compressed air from the line 108. Should pressure be lost in the line while the bucket is elevated, an operator therein need only open the valve 122 to release the air in the tank to the bucket switches, whereby the bucket may be safely lowered.

The invention thus provides a safe, economical and long life control system for hydraulic lifts, with duplicate sets of switches which allow precise control of the lift from either a ground station or a bucket. As a consequence of low pressure compressed air being applied through the switches as compared with high pressure hydraulic fluid in conventional systems, relatively small, inexpensive and easily replaceable lines may be extended along the mechanical arms to the switches, and considerable safety is afforded to an operator of the switches in the event of rupture of a line. Since fluid flows in the hydraulic circuit only during operation of the lift, the pump for the fluid is economical to operate, minimum heat is generated within the system, and the system has a greatly extended life. As a consequence of the adjustable metering valves in the fluid lines to the hydraulic cylinders, operation of the cylinders is very smooth, and the speed thereof may be readily controlled.

While one embodiment of the invention has been described in detail, other modifications and various embodiments thereof may be devised by one skilled in the art without departing from the spirit and the scope of the invention, as defined by the claims.

What is claimed is:

1. In a system for operating a hydraulic cylinder of a hydraulic lift, said cylinder having first and second fluid inlets thereto, a closed center hydraulic circuit in which hydraulic fluid flows only upon operation of said cylinder and including pump means for providing hydraulic fluid under pressure to said circuit; motor means for driving said pump means, said motor means operating continuously during operation of said system and said pump means operating to provide fluid only upon operation of said cylinder and when the pressure of fluid in said circuit is less than a predetermined value, whereby said pump means and motor means maintain the pressure of fluid in said circuit at the predetermined value; directional valve means for receiving the fluid under pressure, said valve means being connected with said cylinder inlets, and means for controlling said valve means to selectively apply the fluid under pressure therethrough to one or the other of said inlets to operate said cylinder in a first or a second direction.

2. In a system as set forth in claim 1, said valve means also for connecting with a supply reservoir of the fluid, and connecting said first cylinder inlet with the supply when the fluid under pressure is applied to said second inlet, and connecting said second cylinder inlet with the supply when the fluid under pressure is applied to said first inlet, said pump means being connectable with the supply reservoir to provide therefrom to said hydraulic circuit.

3. In a system as set forth in claim 2, said valve means being a pilot controlled directional valve having an inlet for connecting with the fluid under pressure from said pump means, an outlet for connecting with the supply reservoir of fluid, a first port for connecting with said first cylinder inlet, said valve control means connecting with said pilots for controlling said directional valve to selectively (a) connect said valve inlet with said first port and said outlet with second port, (b) connect said inlet with said second port and said outlet with said first port, or (c) remove said connections between said inlet, said outlet and said ports.

4. In a system as set forth in claim 3, a first fluid metering valve connected between said first port and said first cylinder inlet, and a second fluid metering valve connected between said second port and said second cylinder inlet, for controlling the rate of fluid flow from said ports to said inlets.

5. In a system as set forth in claim 4, said fluid metering valves being adjustable to selectively control the rate of fluid flow therethrough, and first and second fluid check valves connected across said first and second fluid metering valves, respectively, with outlets from said check valves toward said cylinder inlets, said check valves opening and passing fluid around said metering valve connected with said directional valve inlet and closing to constrain a flow of fluid through said metering valve connected with said directional valve outlet.

6. In a system as set forth in claim 5, a first pilot controlled check valve having an inlet and an outlet, connected between said first metering valve and said first cylinder inlet with said inlet toward said metering valve, and a second pilot controlled check valve having an inlet and an outlet, connected between said second metering valve and said second cylinder inlet with said inlet toward said metering valve, said pilot of each said check valve being connected to sense the fluid pressure at said inlet to said other check valve to open its valve for a flow of fluid therethrough from said outlet to said inlet upon a predetermined relationship between the fluid pressure at said pilot and at said outlet of said valve, whereby upon said control means connecting said directional valve inlet with said first port paths are established for a flow of fluid under pressure through said first check valve and said first pilot controlled check valve to said first cylinder inlet and from said second cylinder inlet through said second pilot controlled check valve, said second metering valve and said second port to the fluid supply to move said cylinder, and therethrough said lift, in said first direction, and upon said control means connecting said directional valve inlet with said second port paths are established for a flow of fluid under pressure through said second check valve and said second pilot controlled check valve to said second inlet to said cylinder, and from said first cylinder inlet through said first pilot controlled directional valve, said first metering valve and said first port to the fluid supply to move said cylinder, and therethrough said lift, in said second direction, said metering valves controlling the rate of fluid flow therethrough and thereby controlling the speed of operation of said lift, said first and second pilot controlled check valves preventing movement of said cylinder in the event of loss of fluid pressure at the inlets to said valves.

7. In a system as set forth in claim 3, said directional valve pilots being operable by compressed air applied thereto, said valve control means including means for controlling the application of compressed air to said pilots.

8. In a system as set forth in claim 7, wherein said hydraulic lift is a hydraulic bucket lift of a type having a ground station and a bucket for being elevated by operation of said cylinder, said valve control means including a first plurality of air switches, each for connecting at an inlet thereto with a source of compressed air and at an outlet therefrom with an associated one of said pilots, whereby actuation of said switches applies compressed air to said pilots to operate said directional valve.

9. In a system as set forth in claim 8, wherein said first plurality of air switches are locatable in said bucket, a second plurality of air switches located at said ground station, each for connecting at an inlet thereto with said source of compressed air and at an outlet therefrom with an associated one of said pilots, whereby each of said pilots is connected with an outlet from an associated switch of each of said first and second pluralities.

10. In a system as set forth in claim 9, a plurality of two-input air operated OR elements, each connected at an outlet therefrom with an associated one of said pilots, each connected at a first inlet thereto with the outlet from an associated switch of said first plurality, and connected at a second inlet thereto with the outlet from an associated switch of said second plurality.

11. In a system as set forth in claim 10, each switch of said first plurality connected with said first inlet of said associated OR element through an air line and a quick exhaust valve in series therewith, said quick exhaust valve being closed to atmosphere upon actuation of said associated switch to apply compressed air through said OR element to said associated pilot, said quick exhaust valve opening to atmosphere upon deactuation of said switch to exhaust to atmosphere compressed air in said pilot.

12. In a control system for operating a bucket lift of a type having a plurality of pivotally interconnected arms extending between a base and a bucket and a plurality of dual inlet hydraulic cylinders connected to rotate said base and to pivot said arms with respect to each other to raise and lower said bucket, a closed center hydraulic circuit in which hydraulic fluid flows only upon operation of one or more of said cylinders and including a plurality of directional valve means for receiving hydraulic fluid under pressure, each connected with first and second inlets to an associated cylinder; pump means for supplying said fluid under pressure to said plurality of valve means; motor means for driving said pump means, said motor means operating continuously during operation of said system and said pump means operating to provide fluid only upon operation of at least one of said cylinders and when the pressure of fluid in said circuit is less than a predetermined value, whereby said pump means and motor means maintain the pressure of fluid in said circuit at the predetermined value; and means for controlling said valve means to selectively apply the fluid under pressure to one or the other of said inlets to selected cylinders to operate said cylinders to raise, to lower or to rotate said bucket, said pump means normally operating only upon operation of said cylinders.

13. In a control system a set forth in claim 12, each of said valve means including a pilot controlled fluid directional valve, said pilots being compressed air operated, said means for controlling said valve means including a plurality of air switches in said bucket, each for being connected at an inlet thereto with a source of compressed air and at an outlet therefrom with an associated pilot of said valves, said switches being actuable to selectively apply compressed air to said pilots to operate said cylinders.

14. In a system for operating a hydraulic cylinder of a hydraulic bucket lift of a type having a ground station and a bucket for being elevated, a cylinder connected with said bucket for elevating said bucket, said cylinder having first and second inlets thereof; a closed center hydraulic circut including directional valve means for receiving hydraulic fluid under pressure connected with said cylinder inlets, said valve means being a pilot controlled directional valve having an inlet for connecting with said fluid under pressure, an outlet for connecting with a supply of fluid, a first port for connecting with said first cylinder inlet, and a second port for connecting with said second cylinder inlet, said pilots being operable by compressed air applied thereto to selectively (a) connect said valve inlet with said first port and said outlet with said second port, (b) connect said inlet with said second port and said outlet with said first port, or (c) remove said connections between said inlet, said outlet and said ports; valve control means for controlling the application of compressed air to said pilots to selectively apply fluid under pressure to one or the other or neither of said cylinder inlets, said valve control means including a first plurality of air switches locatable in said bucket and a second plurality of air switches locatable at said ground station, each for connecting at an inlet thereto with the source of compressed air and at an outlet therefrom with an associated one of said pilots, whereby each of said pilots is connected with an outlet from an associated switch of each of said first and second pluralities; a plurality of two-input air operated OR elements, each connected at an outlet therefrom with an associated one of said pilots, at a first inlet thereto with the outlet from an associated switch of said first plurality, and at a second inlet thereto with the outlet from an associated switch of said second plurality; a plurality of quick exhaust valves each switch of said first plurality connected with said first inlet to said associated OR element through an associated one of said quick exhaust valves, said quick exhaust valve being closed to atmosphere upon actuation of said associated switch to apply compressed air through said OR element to said associated pilot, said quick exhaust valve operating to atmosphere upon deactuation of said switch to exhaust to atmosphere compressed air in said pilot; a first check valve connected between the source of compressed air and said inlets to said first plurality of switches with an inlet thereto connected to the source of compressed air and an outlet therefrom connected with said switch inlets; a second check valve connected at an inlet thereto with said inlet to said first check valve; an air storage tank connected at an inlet thereto with an outlet from said second check valve; and a shut off valve connected between an outlet from said tank and an outlet from said first check valve, said shut off valve normally being closed to store in in said tank compressed air from the source thereof, and being operable to supply compressed air from said tank to said inlets to said first plurality of switches upon loss of compressed air from the source.

* * * * *